US009771728B2

(12) United States Patent
Gilpin et al.

(10) Patent No.: US 9,771,728 B2
(45) Date of Patent: Sep. 26, 2017

(54) DEVICE FOR FORMING A VOID IN A CONCRETE FOUNDATION

(71) Applicants: Dennard Charles Gilpin, Austin, TX (US); Bruce Duane Stiles, Llano, TX (US); Stephen Ray Stiles, Liberty Hill, TX (US)

(72) Inventors: Dennard Charles Gilpin, Austin, TX (US); Bruce Duane Stiles, Llano, TX (US); Stephen Ray Stiles, Liberty Hill, TX (US)

( * ) Notice: Subject to any disclaimer, the term of this patent is extended or adjusted under 35 U.S.C. 154(b) by 782 days.

(21) Appl. No.: 13/901,085

(22) Filed: May 23, 2013

(65) Prior Publication Data

US 2013/0313740 A1 Nov. 28, 2013

Related U.S. Application Data

(60) Provisional application No. 61/650,589, filed on May 23, 2012.

(51) Int. Cl.

| | |
|---|---|
| ***E04G 15/06*** | (2006.01) |
| ***E04G 15/00*** | (2006.01) |
| ***E04G 9/08*** | (2006.01) |
| *E02D 27/00* | (2006.01) |

(52) U.S. Cl.

CPC ..... *E04G 15/061* (2013.01); *E04G 9/086* (2013.01); *E04G 15/00* (2013.01); *E02D 27/00* (2013.01)

(58) Field of Classification Search

CPC ..... E04G 15/00; E04G 15/061; E04G 9/086
See application file for complete search history.

(56) References Cited

U.S. PATENT DOCUMENTS 1,440,547 A * 1/1923 Luellen ..... B65D 1/34 229/120.17
1,628,931 A * 5/1927 Todd ..... D21C 5/022 162/8
2,527,025 A * 10/1950 Morgan ..... B65D 71/0051 206/195
2,656,945 A * 10/1953 Grant ..... B65D 85/322 217/26.5
2,939,602 A * 6/1960 Grant ..... B65D 85/324 206/521.1

(Continued)

OTHER PUBLICATIONS

SureVoid Products, Inc.—SlabVoid, www.surevoid.com, Copyright 2002.
SuperVoid Website—www.supervoid.com, printed Jun. 30, 2011.

*Primary Examiner* — Michael Safavi
(74) *Attorney, Agent, or Firm* — Meyertons, Hood, Kivlin, Kowert & Goetzel, P.C.

(57) ABSTRACT

This disclosure describes devices and methods for forming voids in or adjacent concrete structures. In some embodiments, a device may include a structure. The structure may be substantially planar. The structure may include a plurality of channels extending therefrom. In some embodiments, the channels are closed at a first end distal from the structure. In some embodiments, the channels are open at a second end proximal to the structure. In some embodiments, the device may be formed from a molded pulp. The molded pulp may be configured to inhibit penetration of water. In some embodiments, the device may be configured to substantially support poured concrete during at least a portion of a curing process of the poured concrete.

30 Claims, 1 Drawing Sheet

(56) References Cited

U.S. PATENT DOCUMENTS 3,040,948 A * 6/1962 Wells ..... B65D 81/264 229/407
3,334,765 A * 8/1967 Modersohn ..... B65D 85/322 206/521.1
3,356,462 A * 12/1967 Cooke ..... B01L 3/5085 206/509
3,664,241 A 5/1972 Blackburn
3,720,344 A * 3/1973 De Vries ..... B65D 85/322 217/26.5
3,757,481 A * 9/1973 Skinner ..... E02D 27/01 428/178
3,802,790 A * 4/1974 Blackburn ..... E01C 7/14 264/31
3,834,487 A * 9/1974 Hale ..... E04B 1/86 181/292
3,863,414 A 2/1975 Dunn, Jr.
4,033,546 A * 7/1977 Guegan ..... B22D 7/12 249/174
4,125,980 A * 11/1978 Miraldi ..... E02D 27/02 249/19
4,179,270 A * 12/1979 Clayton ..... C10L 11/04 206/204
4,685,267 A 8/1987 Workman
4,829,006 A * 5/1989 Smith ..... B01L 3/5021 215/354
5,052,161 A * 10/1991 Whitacre ..... E04F 15/18 52/385
5,230,943 A * 7/1993 Pregont ..... B65D 81/09 206/523
5,383,314 A * 1/1995 Rothberg ..... E02D 31/02 405/43
5,503,709 A * 4/1996 Burton ..... D21C 5/02 162/190
5,554,024 A * 9/1996 Ueda ..... A61C 9/0006 433/37
5,573,693 A * 11/1996 Lorence ..... B65D 65/42 219/730
5,603,899 A * 2/1997 Franciskovich .... B01L 3/50255 422/527
5,700,516 A * 12/1997 Sandvick ..... C08L 91/06 162/189
5,782,049 A 7/1998 Gates et al.
5,799,455 A 9/1998 Gates et al.
5,915,884 A * 6/1999 Gates ..... E02D 19/185 249/52
6,050,043 A 4/2000 Rosenblat et al.
6,116,568 A * 9/2000 Rosenblat ..... B28B 7/28 229/120.17
6,159,399 A * 12/2000 Schmid ..... E04B 1/6816 249/38
6,289,638 B1 9/2001 Vasseur
6,578,814 B2 6/2003 Hoyle et al.
6,786,013 B2 * 9/2004 Coulton ..... B32B 3/28 405/45
6,794,017 B2 9/2004 Comeau et al.
6,830,658 B2 12/2004 Kumamoto et al.
7,353,641 B2 * 4/2008 Yoshii ..... B28B 7/28 249/DIG. 2
7,771,814 B2 * 8/2010 Grimble ..... B27N 5/00 249/16
9,103,076 B2 * 8/2015 Hassan ..... E01C 13/00
9,249,587 B2 * 2/2016 Hunt ..... E02D 27/013
2001/0041749 A1 * 11/2001 Severtson ..... B01D 17/047 516/39
2002/0145099 A1 10/2002 Hoyle et al.
2004/0033343 A1 2/2004 Comeau et al.
2005/0011152 A1 1/2005 O'Grady et al.
2005/0098704 A1 * 5/2005 Bucknell ..... E01C 9/001 249/2
2006/0016719 A1 * 1/2006 Cassese ..... A47G 19/06 206/564
2007/0194205 A1 * 8/2007 Blackmon ..... E04G 15/063 249/185
2008/0113161 A1 5/2008 Grimble et al.
2011/0120036 A1 5/2011 Wignall et al.
2011/0120995 A1 * 5/2011 Landry ..... B65D 1/36 220/23.8
2011/0305526 A1 12/2011 Turner et al.
2012/0042605 A1 2/2012 Turner et al.
2014/0300026 A1 * 10/2014 Taccolini ..... B29C 41/18 264/129
2017/0009468 A1 1/2017 Turner

* cited by examiner

DEVICE FOR FORMING A VOID IN A CONCRETE FOUNDATION

PRIORITY CLAIM

This application claims priority to U.S. Provisional Patent Application No. 61/650,589 entitled "CONCRETE VOID FORMING METHOD AND DEVICE" filed on May 23, 2012, which is incorporated by reference herein.

BACKGROUND OF THE INVENTION

1. Field of the Invention

The present disclosure generally relates to concrete void forming methods and devices. More particularly, the disclosure generally relates to a form for use in creating a void underneath a concrete slab.

2. Description of the Relevant Art

The construction industry commonly creates voids in and/or under various concrete formations. Concrete formations below grade often require a space or void between the foundation and the ground to accommodate expansion of the soil. Soil expansion may lead to foundation damage. For example, creating a void between the structural floor and/or grade beams of a foundation and the underlying soil may accommodate upheaval of the soil. Voids may be desirable to create in and/or around any below grade structure, typically formed from concrete. Voids may be used above grade between concrete floor slabs to reduce the amount of concrete required and to make the resulting slab lighter. Voids may be formed anywhere in concrete structures where openings would be useful (e.g., internal plumbing, electrical wiring, etc.).

Previously voids have been created by placing a biodegradable support structure made of corrugated cardboard in the desired location. These support structures are configured to support the building structural components until the poured concrete is capable of holding its own weight. As the concrete dries, and as the cardboard eventually deteriorates, a void is left in the concrete formation. Such support structures are typically difficult to assemble and often can only be assembled at a factory and transported to a construction site. Current cardboard forms are susceptible to moisture resulting in the forms collapsing under the weight of the wet concrete. Premature collapse of the forms results in loss of the desired void.

U.S. Pat. No. 5,782,049 issued to Gates et al. (hereinafter "Gates") discloses a trapezoidal form void is fabricated from corrugated paper and has a two-part structure permitting complete separation of the two parts. However, Gates does not disclose a void form which resists deformation due to moisture and allows soil to fill the pockets formed by the void form over time as the soil expands.

U.S. Pat. No. 6,116,568 issued to Rosenblatt et al. (hereinafter "Rosenblatt") discloses a reinforced box-like structure for forming a void area in a concrete formation. The box structure includes a bottom panel having a plurality of spaced apart, parallel base partitions and a top panel having a plurality of spaced apart, parallel top partitions. However, Rosenblatt does not disclose a void form which resists deformation due to moisture and allows soil to fill the pockets formed by the void form over time as the soil expands.

U.S. Pat. No. 6,289,638 issued to Vasseur (hereinafter "Vasseur") discloses an apparatus for creating a void under a structural concrete slab which includes a body having a bottom surface with projections which deform and then collapse after a preset displacement in response to subgrade compressive stress. However, Vasseur does not disclose a void form which resists deformation due to moisture and allows soil to fill the pockets formed by the void form over time as the soil expands.

U.S. Pat. No. 6,830,658 issued to Kumamoto et al. (hereinafter "Kumamoto") discloses a method for producing a pulp molded article. However, Kumamoto does not disclose a void form which resists deformation due to moisture and allows soil to fill the pockets formed by the void form over time as the soil expands.

U.S. Pat. No. 6,794,017 issued to Comeau et al. (hereinafter "Comeau") discloses corrugated cardboard that resists the growth of mold and a process for producing it. The cardboard is useful in the construction of void-forming structures. However, Comeau does not disclose a void form which resists deformation due to moisture and allows soil to fill the pockets formed by the void form over time as the soil expands.

United States Publication No. 2005/0011152 issued to O'Grady et al. (hereinafter "O'Grady") discloses cavity formers made of a degradable material to facilitate disintegration of the cavity former over time to leave a cavity within the formed concrete slab. However, O'Grady does not disclose a void form which resists deformation due to moisture and allows soil to fill the pockets formed by the void form over time as the soil expands.

United States Publication No. 2008/0113161 issued to Grimble et al. (hereinafter "Grimble") discloses a former for one-time use made of recycled paper or wood fiber pulp molded into the requisite former shape. However, Grimble does not disclose a void form which resists deformation due to moisture and allows soil to fill the pockets formed by the void form over time as the soil expands.

United States Publication No. 2011/0120036 issued to Wignall et al. (hereinafter "Wignall") discloses an apparatus for creating a void beneath a structural concrete slab, comprising: a body having a first surface adapted to support wet concrete for forming at least a portion of the concrete slab and a second surface adapted to contact a ground surface. However, Wignall does not disclose a void form which resists deformation due to moisture and allows soil to fill the pockets formed by the void form over time as the soil expands.

Although there exist many different types of void forming devices none of the known devices accomplish what the herein described void forming device is capable of.

What is needed is a device for forming a void in, for example, a concrete foundation which will withstand pressures created by the weight of the wet concrete as well as resist premature deterioration when exposed to the elements (e.g., water).

SUMMARY

This disclosure describes devices and methods for forming voids in or adjacent concrete structures. In some embodiments, a device may include a structure. The structure may be substantially planar. The structure may include a plurality of channels extending therefrom. In some embodiments, the channels are closed at a first end distal from the structure. In some embodiments, the channels are open at a second end proximal to the structure. In some embodiments, the device may be formed from a molded pulp.

In some embodiments, the molded pulp may be configured to inhibit penetration of moisture. In some embodiments, the device may be configured to substantially support poured concrete during at least a portion of a curing process of the poured concrete. The molded pulp may be configured to inhibit structural failure due to exposure to water.

In some embodiments, the molded pulp may include wax. The molded pulp may be formed at least in part from wax coated corrugated cardboard. At least about 30-100% of a pulp used to form the molded pulp may be wax coated corrugated cardboard. At least about 40-80% of a pulp used to form the molded pulp may be wax coated corrugated cardboard. At least about 40-60% of a pulp used to form the molded pulp may be wax coated corrugated cardboard. At least about 50-60% of a pulp used to form the molded pulp may be wax coated corrugated cardboard.

In some embodiments, the device further comprises a coating applied to at least a portion of at least one surface of the device. The coating may inhibit penetration of water.

In some embodiments, the first end of the channels comprises an opening. The opening may be between about 1 to about 2 inches in diameter. At least one of the openings may be configured to allow surface material to be conveyed through at least one of the openings into the channels.

In some embodiments, two or more of the devices are such that channels of a first device at least are partially positionable in the channels of a second device such that the devices when stacked occupy less space for shipment. The channels may include a substantially tapered shape such that channels of a first device at least are partially positionable in the channels of a second device.

In some embodiments, a method for forming voids in or adjacent concrete structures may include positioning a device, as described herein, for forming voids in concrete structures. The device may be positioned such that the second ends of the channels are facing substantially upwards. The method may include pouring concrete over at least a portion of the device. The method may include inhibiting penetration of water in the device. The method may include supporting the poured concrete using the device during at least a portion of the curing process of the poured concrete. In some embodiments, the method may include allowing material to be conveyed through at least one of opening in the first end of the channels.

BRIEF DESCRIPTION OF THE DRAWINGS

Advantages of the present invention may become apparent to those skilled in the art with the benefit of the following detailed description of the preferred embodiments and upon reference to the accompanying drawings.

Figure 1:
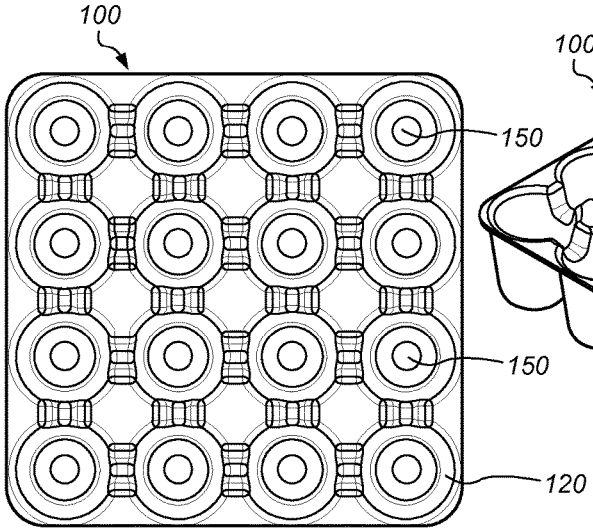
FIG. 1 depicts a representation of a top view of an embodiment of a void forming device.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

It is to be understood the present invention is not limited to particular devices or biological systems, which may, of course, vary. It is also to be understood that the terminology used herein is for the purpose of describing particular embodiments only, and is not intended to be limiting. As used in this specification and the appended claims, the singular forms "a", "an", and "the" include singular and plural referents unless the content clearly dictates otherwise. Thus, for example, reference to "a linker" includes one or more linkers.

Definitions

Unless defined otherwise, all technical and scientific terms used herein have the same meaning as commonly understood by one of ordinary skill in the art.

The term "connected" as used herein generally refers to pieces which may be joined or linked together.

The term "coupled" as used herein generally refers to pieces which may be used operatively with each other, or joined or linked together, with or without one or more intervening members.

The term "directly" as used herein generally refers to one structure in physical contact with another structure, or, when used in reference to a procedure, means that one process effects another process or structure without the involvement of an intermediate step or component.

In some embodiments, a device may form a void in, for example, a concrete foundation. The device may withstand pressures created by the weight of the wet concrete while the concrete cures. The device may inhibit penetration of water in the structure of the device itself. In some embodiments, the device may inhibit penetration of water in the structure of the device itself such that premature deterioration of the device is inhibited when exposed to the elements (e.g., water).

Currently many void forming devices are formed from corrugated cardboard. However, corrugated cardboard forms have several disadvantages. The first and potentially most damaging disadvantage of corrugated cardboard forms is how quickly they weaken structurally when exposed to moisture. This disadvantage is exacerbated due to the fact that if even when a small portion of a corrugated cardboard form is exposed to moisture the cardboard wicks the water through to any cardboard connected to the exposed portion of the cardboard. This disadvantage leads to severely limiting the use of corrugated cardboard forms due to the fact that corrugated cardboard forms are generally used outside and exposed to the elements. After corrugated cardboard forms have been positioned they may be exposed to the elements for days before concrete is poured covering the forms. Users therefore have to be concerned about, for example, the weather and the potential for rain which could weaken corrugated cardboard forms. If the corrugated cardboard forms are exposed to moisture, they may have to be replaced. Potential delays such as this are very costly for, especially, large construction projects which require the use of such forms.

A second disadvantage is that it is inherently difficult to design a corrugated cardboard form which is structurally strong enough to support the required weights during use. Uncured concrete weighs approximately 150 lbs/ft$^2$. Typically concrete slabs range in depth from 6 feet for beams to about 6 inches for slabs. Therefore, corrugated cardboard forms require intricate engineering to insure they will support the wet concrete. The corrugated cardboard forms cannot be cut, bent, or modified in the field without loosing structural strength. Thus each slab must be designed to insure proper fitting with multiple sizes and shapes. In addition the different shapes and sizes must be placed properly in the field to work properly.

A third disadvantage is that the corrugated cardboard form requires assembly of multiple pieces using glue or staples. Improper assembly can result in loss of structural strength.

Figure 2:
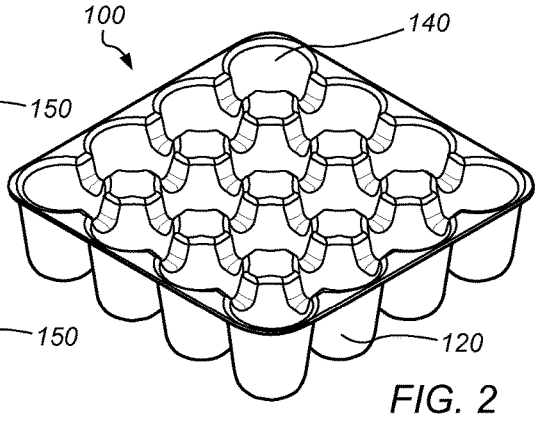
FIG. 2 depicts a representation of a perspective view of an embodiment of a void forming device.

FIGS. 1-5 depict various embodiments of void forming devices 100. FIG. 1 depicts a representation of a top view of an embodiment of void forming device 100. FIG. 2 depicts a representation of a perspective view of an embodiment of void forming device 100. Void forming device 100 may include structure 110. In some embodiments, structure 110 may be substantially planar. In some embodiments, structure 110 may include plurality of channels 120 extending from the structure.

In some embodiments, one or more of channels 120 extending from structure 110 may be closed at first end 130 distal from structure 110. The plurality of channels may have substantially equivalent lengths. The plurality of channels may appear to resemble inverted drinking glasses. In some embodiments, channels 120 may be spaced equally about structure 110.

In some embodiments, one or more of channels 120 extending from structure 110 may be open at second end 140 proximal to structure 110. The shape of the openings at second end 140 may include any of a variety of shapes. In some embodiments, a void forming device may include openings with different shapes. In some embodiments, a void forming device may include openings having substantially equivalent shapes.

The shape of the channels may include any of a variety of shapes. In some embodiments, a void forming device may include channels with different shaped cross-sections. In some embodiments, a void forming device may include channels having substantially equivalent shaped cross-sections.

In some embodiment, at least some of the channels may be tapered. The channels may taper from second end 140 to first end 130. The channels may include a substantially tapered shape such that channels of a first device at least are partially positionable in the channels of a second device. Channels from a first device may be positionable in the channels of a second device such that void forming devices may be stacked more efficiently. The ability to stack void forming devices more efficiently in a nested configuration allows for easier transportation of the devices, for example, reducing transportation costs.

In some embodiments, void forming devices 100 may include at least one opening 150. Openings 150 may function to allow some forms of material adjacent to an installed device 100 to be conveyed through the openings. Materials would typically include soil upon which device 100 is positioned. Allowing soil to be conveyed through the openings into the channels of the device may allow the substrate beneath the positioned devices to shift to an extent without disturbing the devices or the curing concrete the devices are supporting. Substrate conveyed through openings 150 may reduce any settling of the foundation devices 100 are supporting as the device decompose and structurally break down after the concrete has cured.

In some embodiments, openings 150 may be positioned at first end 130 of channels 120 (e.g., as depicted in FIG. 1). Each channel may include one or multiple openings. Openings may have any size and/or shape. In some embodiments, openings may be about one to about two inches in diameter. In some embodiments, openings may be round (e.g., as depicted in FIG. 1).

Figure 4:
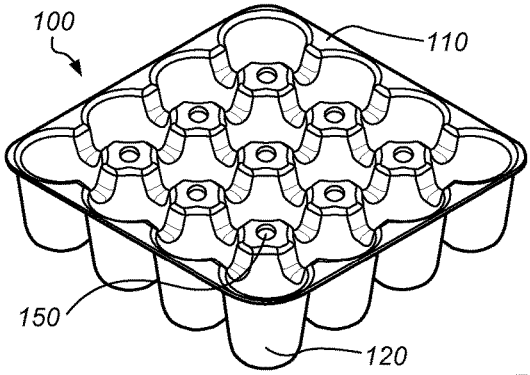
FIG. 4 depicts a representation of a perspective view of an embodiment of a void forming device.
Figure 3:
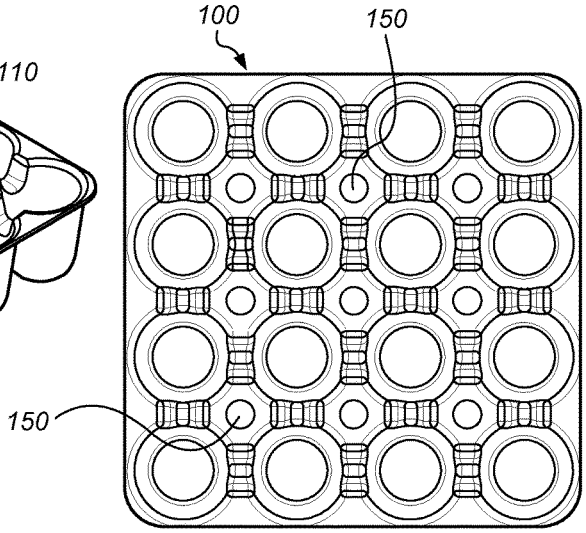
FIG. 3 depicts a representation of a top view of an embodiment of a void forming device.

In some embodiments, openings 150 may be positioned adjacent second end 140 of channels 120 (e.g., as depicted in FIGS. 3-4). FIG. 3 depicts a representation of a top view of an embodiment of void forming device 100. FIG. 4 depicts a representation of a perspective view of an embodiment of void forming device 100. In some embodiments openings may be positioned as depicted in both FIGS. 1 and 4.

Void forming devices 100 may be manufactured with almost any dimensions as necessary depending upon the job requirements. In some embodiments, void forming devices may be about three inches to about twelve inches or about five inches to about seven inches in height. In some embodiments, void forming devices may be about six inches in height. In some embodiments, void forming devices may have a length of about two feet and a width of about two feet. In some embodiments, void forming devices may have a length of about two feet and a width of about four feet. Larger devices are better but limited by restrictions due to manufacturing and costs due to increased size. Also as the dimensions of the devices increases transportation and handling on site may become problematic. In different embodiments, void forming devices may include different dimensions for different purposes including, for example:

- 2 foot width×2 foot length×6 inches tall thick wall for beams;
- 2 foot width×2 foot length×6 inches tall thin wall for slabs;
- 2 foot width×2 foot length×4 inches tall thick wall for beams;
- 2 foot width×2 foot length×4 inches tall thin wall for slabs;
- 2 foot width×4 foot length×6 inches tall thick wall for beams;
- 2 foot width×4 foot length×6 inches tall thin wall for slabs;
- 2 foot width×4 foot length×4 inches tall thick wall for beams; and
- 2 foot width×4 foot length×4 inches tall thin wall for slabs.

In some embodiments, void forming devices 100 may include any number of channels 120 as needed. In some embodiments, void forming devices 100 may include about 16 channels 120 as depicted in the figures. In some embodiments, void forming devices 100 may include about 4-8, 8-16, or 16-32 channels 120.

In some embodiments, at least a portion of a void forming device may be formed from molded pulp. Molded pulp may also be referred to as moulded pulp or molded fibre. Molded pulp is typically used as a packaging material. Molded pulp is considered by many as a sustainable packaging material since it is produced from recycled materials, and can be recycled again after its useful life-cycle.

Molded pulp may be from paperboard (e.g., recycled) and/or newsprint. Molded pulp may be used for protective packaging or for food service trays and beverage carriers. Other uses for molded pulp may include end trays, trays, plates, bowls, and food containers. In many instances molded pulp is less expansive to use than other common materials including polyethylene terephthalate, expanded polystyrene, and polyvinyl chloride.

There are different types of molded pulp which can be manufactured using a variety of different methods. There are at least four types of molded pulp: thick-wall, transfer molded, thermoformed fiber, and processed.

Thick-wall molded pulp products usually have wall thicknesses of about 3/16" to about 1/2". Thick-wall molded pulp products are typically used for support packaging applications. Thick-wall molded pulp products are also commonly referred to as slush molded. The surfaces of thick-wall molded pulp products may be very rough on one side and relatively smooth on the opposing side. Typically, product definition is moderate due to the use of relatively inexpensive single-pass molds and the use of mixed recovered paper and kraft paper slurries. Common uses are for edge and edge protector, heavy item packaging, auto replacement parts, molded pulp pallet trays etc.

Transfer molded products are typically thin walled, about 1/16" to about 3/16". Transfer molded products are the most common type found in use today. Typical uses of transfer molded products are for packaging electronic equipment, cellular phones and other household and hardware items. The method for producing transfer molded products typically uses vacuum forming and take-off or transfer molds. The mold may be an extremely fine wire mesh in the shape of the upper and/or exposed surface. The fibrous slurries may be made up of a high percentage or entirely of recycled newspaper. Using recycled paper may produce a relatively smooth surface on one side and a fairly smooth surface on an opposing side with good accuracy and definition.

Prior to beginning the molding process, the wire mesh mold is pared with a vacuum chamber which draws water through the mesh into the chamber. The wire mesh mold is typically suspended above a liquid return pool. A fibrous slurry may then be sprayed from below onto the mold, the vacuum drawing the slurry against the wire mesh mold. Upon completion, the excess slurry falls into the return pool for recycling. The mold is then dried and the wire mesh mold is separated from the dried fiber plating.

Thermoformed fiber molded pulp is the highest quality of thin walled products available today. The thermoformed method cures the product in the mold resulting in products that are well defined and smooth surfaced. After being formed, the product is captured in heated forming molds which presses the molded products. The products are formed with a high degree of accuracy. The products are ejected from the heated molds in their finished state. Typical uses for this type are for point of purchase packaging and where appearance is of particular importance.

Processed molded pulp products are that which have undergone secondary processing which is generally different than or in addition to, the basic production method(s). This could apply to any of the first three types. Secondary processing may include coating, printing, hot-pressing, die-cutting, trimming or using special slurry additives. Uses are for many kinds of custom applications.

In some embodiments, thick-wall molded pulp product methods may be used to produce void forming devices described herein.

As mentioned resistance to penetration of water is water is important. In some embodiments, a pulp slurry used to form molded pulp based void forming devices may include materials, compositions, and/or chemicals which inhibit penetration of water into the void forming devices. In some embodiments, one or more waxes may be added to the pulp slurry used to form a void forming device. Waxes may include natural waxes, synthetic waxes, and/or a combination of both. In some embodiments, one or more polymers, additives, and/or hydrophobic materials may be added to the pulp slurry to ensure the void forming device is water resistant. Void forming devices may deteriorate slower that current cardboard carton forms but still create the necessary void within a desired time frame (e.g., 30 days of application). Current cardboard based forms may fail simply by being exposed to humid conditions or several days, to say nothing of being exposed to rain.

In many instances recycled cardboard is used to produce the pulp slurry for making molded pulp products. In some embodiments, wax coated cardboard products may be used to form the pulp slurry. They wax coating on the cardboard will naturally add the wax to the pulp slurry which may be used to ensure the void forming devices are resistant to water. Using wax coated cardboard may have advantages in that recycled cardboard may be used thereby reducing costs. In some embodiments, at least about 30-100% of a pulp used to form the molded pulp may be wax coated corrugated cardboard. In some embodiments, at least about 40-80% of a pulp used to form the molded pulp may be wax coated corrugated cardboard. In some embodiments, at least about 40-60% of a pulp used to form the molded pulp may be wax coated corrugated cardboard. In some embodiments, at least about 50-60% of a pulp used to form the molded pulp may be wax coated corrugated cardboard. In some embodiments, a void forming device is formed with approximately no wax impregnated in the form. In some embodiments, wax impregnated paper may be used to prepare the pulp which is used to create the molded pulp form described herein.

In some embodiments, a coating may be applied to the molded pulp product. A coating may be applied to the molded pulp product instead of or in addition to any additives (e.g., wax) included in the pulp slurry. In some embodiments, hydrophobic coatings resistant to water penetration may be applied to a void forming device. In some embodiments, polymer based compositions may be applied to a void forming device.

In some embodiments, a sizing compound may be added to the void forming device. Sizing compounds may function as a protecting filler or glaze. Sizing compounds may be used to reduce the device's tendency to absorb liquid. Sizing compounds known to one skilled in the art may be used.

Another advantage of the herein described void forming devices is the increased structural strength of the molded pulp devices relative to corrugated cardboard forms currently being used. Uncured concrete weighs approximately 150 lbs/ft$^2$, depending upon the type of mix used. Typically concrete is poured at a depth of about 4 inches to about 6 inches. Therefore, forms must be able to support at least about 75 lbs/ft$^2$ even when wet. In some embodiments, a void forming device may support weights of at least about 75 lbs/ft$^2$, 100 lbs/ft$^2$, 200 lbs/ft$^2$, or 300 lbs/ft$^2$. In some embodiments, a void forming device may be able to structurally support such weights even when wet for at least two, three, or more days. In some embodiments, a void forming device may support weights of at least about 500 lbs/ft$^2$. In some embodiments, a void forming device may be able to support loads for at least 3 days with less than about one inch deflections. Increased structural loads of void forming devices described herein allow users to walk on top of the devices with little fear of damaging the devices (an advantage to corrugated cardboard forms).

In some embodiments, void forming devices may be formed to withstand various different loads. A void forming device may be formed with a thicker profile (e.g., 80 ounces) for applications including, but not limited to, where concrete is poured from about 13 inches thick up to about 36 inches thick. A void forming device may be formed with a relatively thinner profile (e.g., 40 ounces) for applications including, but not limited to, where concrete is poured from about 12 inches thick or less. Concrete slabs may range from 4 inches thick to beams which are 3 feet thick.

Manufacturing void forming devices from molded pulp has other advantages. In some embodiments, void forming devices formed from molded pulp may be biodegradable. In some embodiments, void forming devices formed from molded pulp may be recyclable.

Void forming devices may be cut to fit around pipes, piers, and/or forms. Typically it is not possible to cut currently used cardboard forms around such obstacles. Void forming devices do not need to be assembled only positioned on site, unlike currently used cardboard forms.

Figure 5:
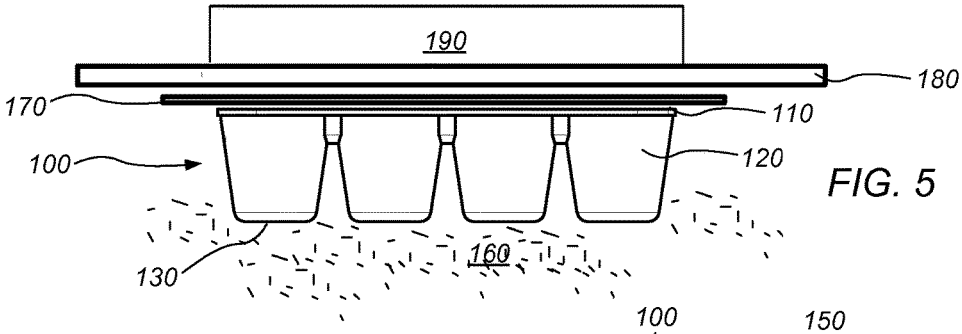
FIG. 5 depicts a representation of a side view of an embodiment of a void forming device.

In some embodiments, a method for forming voids in or adjacent concrete structures may include positioning a device, as described herein, for forming voids in concrete structures. FIG. 5 depicts a representation of a side view of an embodiment of void forming device 100 positioned on substrate 160 during use. The device may be positioned such that the second ends of the channels are facing substantially upwards where a foundation is to be poured (except, for example, where plumbing and piers will be positioned). In some embodiments, framing (e.g., temporary) may be positioned around a perimeter of the pour. In some embodiments, one or more barriers may be positioned over the void forming devices. A barrier may include some type of pliable material. Pliable materials may include plastic sheeting (e.g., polymer films). A barrier may include more rigid materials as well such that the channels of the device are not inadvertently filled with concrete during the pour. Rigid materials may include hardboard otherwise known as masonite. In some embodiments, a layer of plastic sheeting 170 and hardboard 180 may applied to the top of void forming devices. The method may include pouring concrete 190 over the barriers positioned atop the void forming devices. In some embodiments, void forming devices may be positioned, followed by masonite placed on top of the devices. Plastic sheeting may be positioned atop the masonite with cable and/or rebar with supports positioned atop the plastic sheeting. Concrete may then be poured atop the cable and/or rebar.

The method may include inhibiting penetration of water in the device. The method may include supporting the poured concrete using the device during at least a portion of the curing process of the poured concrete. In some embodiments, the method may include allowing material to be conveyed through at least one of opening in the first end of the channels.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A device for forming voids in or adjacent to concrete structures, comprising:

a substantially planar structure comprising a plurality of channels extending therefrom, wherein the plurality of channels are closed at a first end distal from the substantially planar structure and the plurality of channels are open at a second end proximal to the substantially planar structure, wherein the first ends of the plurality of channels comprise an opening;

wherein the device is formed from a molded pulp configured to inhibit penetration of water; and wherein the device is configured to substantially support at least 75 lbs/ft$^2$ of poured concrete during at least a portion of a curing process.

2. The device of claim 1, wherein the molded pulp is configured to inhibit structural failure due to exposure to water.

3. The device of claim 1, wherein the molded pulp comprises wax.

4. The device of claim 1, wherein the molded pulp is formed at least in part from wax coated corrugated cardboard.

5. The device of claim 1, wherein at least about 30-100% of a pulp used to form the molded pulp comprises wax coated corrugated cardboard.

6. The device of claim 1, wherein at least about 40-80% of a pulp used to form the molded pulp comprises wax coated corrugated cardboard.

7. The device of claim 1, wherein at least about 40-60% of a pulp used to form the molded pulp comprises wax coated corrugated cardboard.

8. The device of claim 1, wherein at least about 50-60% of a pulp used to form the molded pulp comprises wax coated corrugated cardboard.

9. The device of claim 1, further comprising a coating applied to at least a portion of at least one surface of the device, wherein the coating inhibits penetration of water.

10. The device of claim 1, wherein the opening is between about 1 to about 2 inches.

11. The device of claim 1, wherein the openings are configured to allow surface material to be conveyed through the openings into the plurality of channels.

12. The device of claim 1, wherein two or more of the devices are such that the plurality of channels of a first device at least are partially positionable in the plurality of channels of a second device such that the devices when stacked occupy less space for shipment.

13. The device of claim 1, wherein the plurality of channels comprise a substantially tapered shape such that the plurality of channels of a first device at least are partially positionable in the plurality of channels of a second device.

14. The device of claim 1, further comprising a plurality of openings extending through the substantially planar structure, wherein the plurality of openings are positioned between the plurality of channels extending from the substantially planar structure.

15. The device of claim 1, further comprising a hydrophobic coating resistant to water penetration applied to at least a portion of a surface of the device.

16. The device of claim 1, wherein the device is configured to substantially support at least 75 lbs/ft$^2$ of poured concrete during at least a portion of a curing process even under wet conditions.

17. The device of claim 1, wherein the device comprises a wall thickness of about 3/16 inch to about ½ inch.

18. The device of claim 1, wherein the molded pulp comprises wax, wax coated corrugated cardboard, and/or a sizing compound.

19. The device of claim 1, wherein the molded pulp is formed at least in part from combining corrugated cardboard with wax and/or a sizing compound.

20. The device of claim 1, wherein the device is configured to substantially support at least 100 lbs/ft$^2$, 200 lbs/ft$^2$, or 300 lbs/ft$^2$ of poured concrete during at least a portion of a curing process.

21. The device of claim 1, wherein the device is configured to substantially support a load for at least three days with less than one inch of deflection.

22. A device for forming voids in or adjacent to concrete structures, comprising:

a substantially planar structure comprising a plurality of channels extending therefrom, wherein the plurality of channels are closed at a first end distal from the substantially planar structure and the plurality of channels is open at a second end proximal to the substantially planar structure;

wherein the first end of the plurality of channels comprises at least one opening configured to allow surface material to be conveyed through at least one of the openings into the plurality of channels;

wherein the device is formed from a molded pulp configured to inhibit penetration of water, wherein the molded pulp comprises wax such that the formed device comprises wax impregnated in the device; and wherein the device is configured to substantially support at least 75 lbs/ft$^2$ of poured concrete during at least a portion of a curing process.

23. The device of claim 22, wherein the molded pulp is configured to inhibit structural failure due to exposure to water.

24. The device of claim 22, further comprising a coating applied to at least a portion of at least one surface of the device, wherein the coating inhibits penetration of water.

25. The device of claim 22, wherein the plurality of channels comprise a substantially tapered shape such that the plurality of channels of a first device at least are partially positionable in the plurality of channels of a second device.

26. The device of claim 22, further comprising a plurality of openings extending through the substantially planar structure, wherein the plurality of openings are positioned between the plurality of channels extending from the substantially planar structure.

27. The device of claim 22, wherein the device comprises a wall thickness of about 3/16 inch to about ½ inch.

28. The device of claim 22, wherein the molded pulp comprises at least one sizing compound.

29. The device of claim 22, wherein the device is configured to substantially support at least 100 lbs/ft$^2$, 200 lbs/ft$^2$, or 300 lbs/ft$^2$ of poured concrete during at least a portion of a curing process.

30. The device of claim 22, wherein the device is configured to substantially support a load for at least three days with less than one inch of deflection.

* * * * *